US005228605A

United States Patent [19]

Schlichenmaier

[11] Patent Number: 5,228,605

[45] Date of Patent: Jul. 20, 1993

[54] AUTOMATICALLY GUIDABLE HAND TOOL FOR APPLYING FREE-FLOWING PASTY MATERIALS TO A BASE

[75] Inventor: Andreas Schlichenmaier, Zaberfeld, Fed. Rep. of Germany

[73] Assignee: Robert Bosch GmbH, Stuttgart, Fed. Rep. of Germany

[21] Appl. No.: 690,905

[22] PCT Filed: Oct. 13, 1989

[86] PCT No.: PCT/DE89/00653

§ 371 Date: Jun. 14, 1991

§ 102(e) Date: Jun. 14, 1991

[87] PCT Pub. No.: WO90/07389

PCT Pub. Date: Jul. 12, 1990

[30] Foreign Application Priority Data

Dec. 30, 1988 [DE] Fed. Rep. of Germany ..... 3844362

[51] Int. Cl.[5] ..... B67D 5/64

[52] U.S. Cl. ..... 222/611.1; 222/612; 222/333; 222/327; 401/48; 401/193

[58] Field of Search ..... 222/608, 611.1, 611.2, 222/612, 613, 614, 626, 333, 327; 401/48, 193; 118/323; 228/43, 45

[56] References Cited

U.S. PATENT DOCUMENTS

| | | | |
|---|---|---|---|
| 2,299,352 | 10/1942 | Sergeant | 222/611.1 X |
| 2,726,616 | 12/1955 | Downing | 228/32 |
| 2,726,620 | 12/1955 | Meissner | 228/32 X |
| 3,148,432 | 9/1964 | Garnett, Jr. | 222/611.2 X |
| 3,175,242 | 3/1965 | Kamondy et al. | 401/193 X |
| 3,208,638 | 9/1965 | Frenzel et al. | 222/333 X |
| 3,381,861 | 5/1968 | Stein | 222/256 |
| 3,550,815 | 12/1970 | Salone | 222/333 X |
| 4,182,264 | 1/1980 | Gibson et al. | 118/306 |
| 4,335,834 | 6/1982 | Zepkin | 222/333 X |

FOREIGN PATENT DOCUMENTS

| | | | |
|---|---|---|---|
| 0067528 | 12/1982 | European Pat. Off. . | |
| 0343003 | 11/1989 | European Pat. Off. | 222/333 |
| 8602533 | 6/1986 | Fed. Rep. of Germany . | |

*Primary Examiner*—Andres Kashnikow
*Assistant Examiner*—Kenneth Bomberg
*Attorney, Agent, or Firm*—Michael J. Striker

[57] ABSTRACT

The hand tool for applying free-flowing pasty materials includes a container with a displaceable base and a nozzle, a piston engagable with the displaceable base to force the free-flowing pasty material from the container, and a guide device for supporting and for guiding the hand tool on the base. The guide device can be contained in a single exchangeable structural unit attached to a cylinder holding the container and includes a first housing part mounted in a telescoping manner in a second housing part fastened to the cylinder; a rotatable wheel connected rotatably to the first housing part, the distance of the rotatable wheel from the nozzle being adjustable because of the mounting of the first housing part in the second housing part in a telescoping manner; and a first drive including an electric motor in the first housing part connected to drive the wheel rotatably and to thus provide a controlled movement of the hand tool over the base during application of the free-flowing pasty material when the wheel contacts the base. The guide device also includes a selecting device for choosing a wheel rotation direction by selecting a motor rotation direction.

8 Claims, 3 Drawing Sheets

AUTOMATICALLY GUIDABLE HAND TOOL FOR APPLYING FREE-FLOWING PASTY MATERIALS TO A BASE

BACKGROUND OF THE INVENTION

The invention relates to a hand tool and, more particularly, to a hand tool having a guide device for applying a free-flowing pasty material to a base.

A hand tool for applying a free-flowing pasty material, an adhesive and/or a sealant, comprises a container with a nozzle and displaceable base, a piston device for forcing the material from the nozzle and guide means supporting and guiding the hand tool during operation.

Such a hand tool is known from U.S. Pat. No. 3,550,815. A hand tool constructed according to this patent is provided with a drive for delivering free-flowing material through a nozzle. The drive is an electric motor which moves a piston in a cylinder via a gear unit and accordingly moves the free-flowing material located in the pressing cylinder to the nozzle. A roller is arranged directly in front of the nozzle, which roller serves to distribute the material when placed on a base, e.g. on a workpiece to be treated.

It is difficult to achieve a uniform application of the material along the length of the surface to be treated with this hand tool, especially in working positions which are uncomfortable for the worker and when the surfaces to be treated are uneven or irregular. In such cases, application with the known hand tool results in interruptions and irregularities or messiness. This is especially unacceptable for visible surfaces.

SUMMARY OF THE INVENTION

It is an object of the present invention to provide an improved automatically guided hand tool for applying free-flowing pasty materials to a base, which has none of the above-mentioned disadvantages.

This object and others which will be made more apparent hereinafter are attained in a hand tool for applying free-flowing pasty materials including adhesives and/or sealants to a base comprising a nozzle and means for containing the free-flowing pasty material communicating with the nozzle, means for forcing the free-flowing pasty material out of the means for containing through the nozzle and guide means for supporting and for guiding the hand tool during application of the free-flowing pasty material to the base.

According to the invention, the guide means includes a first housing part attachable to the means for containing the free-flowing pasty material; a rotatable base-bearing member, which can be a wheel, roller or ball and is held in the first housing part at a distance from the nozzle which is adjustable; means for adjusting the position of the base-bearing member relative to the nozzle; a first drive including a first electric motor connected to the rotatable base-bearing member to drive the rotatable base-bearing member rotatably to provide a controlled movement of the guide means and hand tool over the base during application of the free-flowing pasty material when the base-bearing member contacts the base; and means for selecting a rotation direction of the base-bearing member under control and operation of the first drive such that the base-bearing member is rotatable in another direction opposite to the rotation direction selected by the means for selecting and independently of the first drive.

A hand tool according to the invention has the advantage that the person working with the hand tool need only place the latter on the surface to be treated, whereupon the hand tool is moved automatically by the controllable first drive and guide means. The quantity of material to be applied can be varied by varying the feed speed of the guide means or adjusting the delivery quantity output. The feed direction and the feed speed of the hand tool can be regulated by pressing a switch.

The work of the operator is considerably reduced, so that all his attention can be turned to monitoring the nozzle position. The performance and quality of the work which can be achieved in this way is improved.

The selecting means provided allows selection of a predetermined guide direction during operation of the first drive to guide the hand tool in a controlled manner over the base, however to facilitate application of the free-flowing pasty material the guide means can be movable independently of the drive in a direction opposite to the preselected guide direction.

Advantageously, the hand tool includes another second drive having a second electric motor which powers the means for forcing the free-flowing pasty material onto the base and feeds free-flowing pasty material from the nozzle. The movement of the first drive may be controlled by and coupled to the second other drive.

Means for adjusting the position of the base-bearing member relative to the nozzle includes a second housing part rigidly attachable to the means for containing and structured so that the first housing part containing the first drive can be mounted therein in a telescoping manner.

It is particularly desirable when the guide means is contained in a single exchangeable structural unit which is attachable and detachable from the means for containing in the vicinity of the nozzle.

Thus different guide means can be used for different applications and one guide means can be easily exchangeable with another. Also a defective guide means is easily replaceable by an operable guide means.

In a preferred embodiment of the invention, the contacting the base-bearing member on the base actuates a switch controlling the first drive in the guide means.

BRIEF DESCRIPTION OF THE DRAWING

The objects, features and advantageous of the present invention will now be illustrated in more detail by the following detailed description, reference being made to the accompanying drawing in which.

DETAILED DESCRIPTION OF THE PREFERRED EMBODIMENTS

Figure 1:
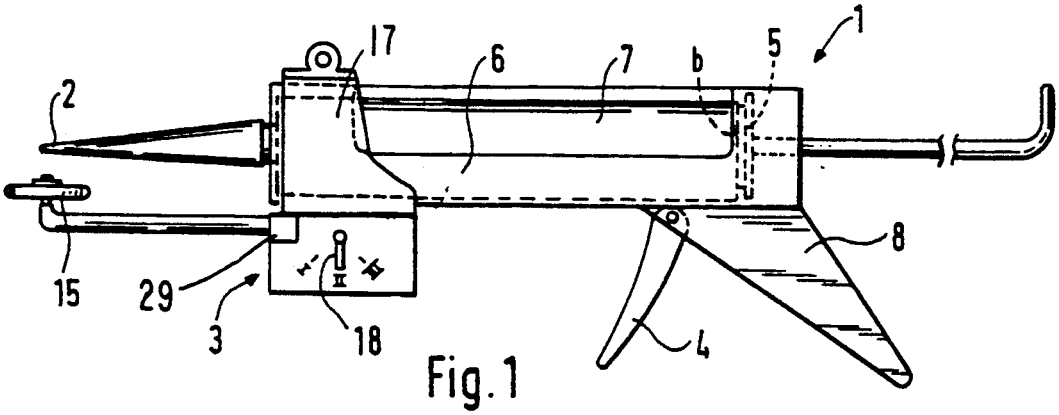
FIG. 1 is a schematic side view of one embodiment of a hand tool with hand-actuated pressing piston and motor-driven guide means.

FIG. 1 shows a first embodiment example of a hand tool 1 which has a nozzle 2 for distributing free-flowing, pasty material and is provided with a guide means 3. The structural details of the hand-powered hand tool 1 is of secondary importance for the invention and is known from DE GM 86 02 533. For this reason, the movement transmission elements between the actuating lever 4 and the piston 5 inside the cylinder 6 are not shown in the drawing. The piston 5 and levers 4 comprise means for forcing the free-flowing material out of the container. A commercially available container 7, i.e. means for containing the pastry material, which is conventionally used for such hand tools is provided with a displaceable base b in a known manner and can be exposed to the pressure of the piston 5 in the cylinder 6. The hand tool 1 is provided with a handle 8 adjacent to the actuating lever 4.

Figure 2:
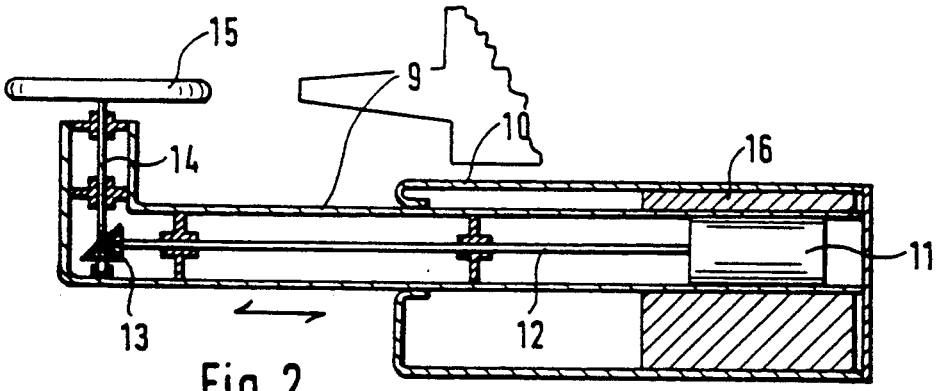
FIG. 2 is a detailed schematic cross-sectional view of an adjustable guide means having a base-bearing member positionable at different distance from the nozzle.

The structure of the structural components parts designated as the guide means 3 can be seen from FIG. 2. The guide means 3 has a first housing part 9 and a second housing part 10, which are supported one inside the other in a telescoping manner. A first drive 11, which is supported in the first housing part 9, comprises a first electric motor which is coupled with an angular gear unit 13 via a drive shaft 12. A base-bearing member 15, in this embodiment a wheel, is coupled with a power take-off shaft 14 of the angular gear unit 13. This wheel is arranged adjacent to the nozzle 2 at a slight distance from the latter. The first housing part 9, together with the base-bearing member 15, the angular gear unit 13, the drive and power take-off shafts 12, 14 and the drive 11, is arranged in an abutment 16 of the second housing part 10 so as to be displaceable parallel to the drive 11. The abutment 16 and the first housing part 9 comprise means for adjustment the position of the base bearing member 15 relative to nozzle 2. A pressure switch 29 can be provided in the second housing part 10 to sense when the base contacted by the base-bearing member 15.

In FIG. 1, the guide means 3 is fastened to the hand tool 1 with a clamp-like fastener 17. A function selector switch 18 has three switch positions: a first switching position determines a motor rotating direction rotating the wheel in the clockwise direction, a second switching position determines a motor rotating direction rotating the wheel in the counterclockwise direction, and a third switching position determines the off position for the drive 11 and accordingly also for the base-bearing member 15.

Figure 3:
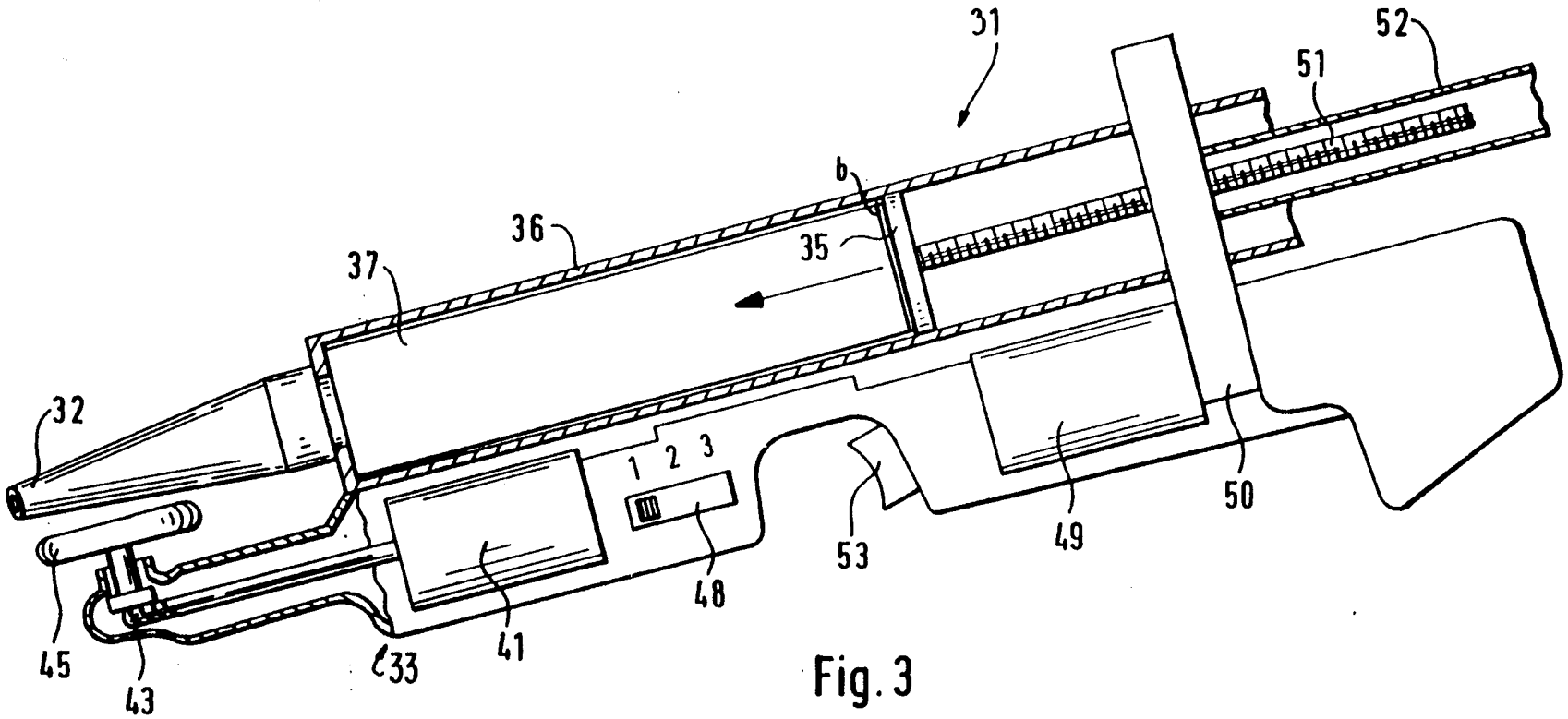
FIG. 3 is a schematic side view of another embodiment of a hand tool with a motor-driven device for forcing the pasty material out of the nozzle coupled to the motor-driven guide means.

FIG. 3 shows a second embodiment example of a hand tool 31 with a nozzle 32, a first drive 41 of a guide means 33 and a second drive 49 for conveying the material through the nozzle 32. The second drive 49 is coupled with a spindle 51 via a gear unit 50, which spindle 51 is provided with a protection tube 52. The piston device 35 is driven by the second drive 49 when the second drive is activated to force the pasty material in container 37 through nozzle 32. An operating switch 53 closes or interrupts an electrical circuit, not shown, to which the second drive 49, which is constructed as a second electrical motor, and the drive 41 are connected. The angular gear unit 43 is a worm gearing. Container 37 is held in holder or cylinder 36.

Figure 4:
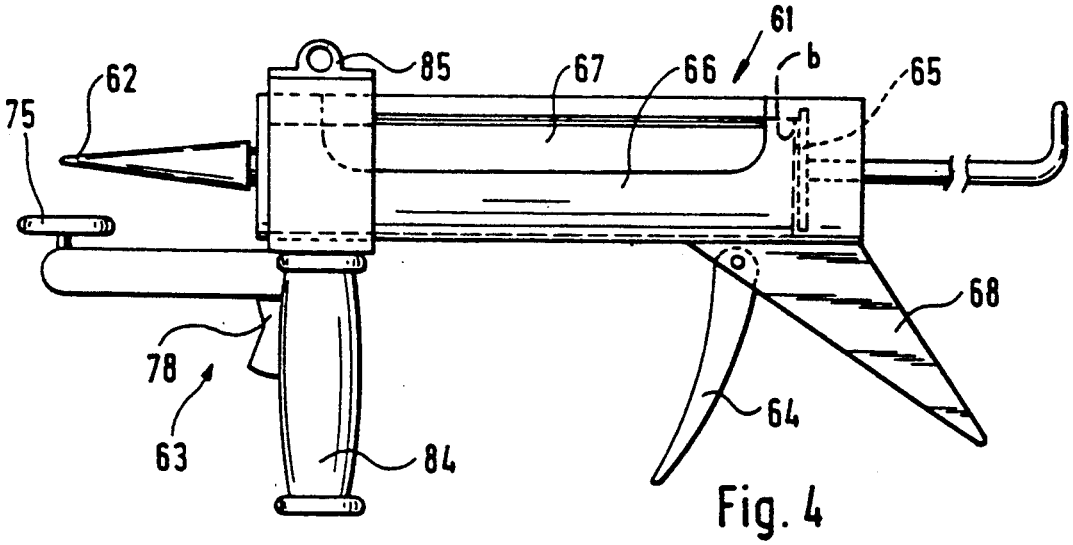
FIG. 4 is a schematic side view of an additional third embodiment of a hand tool with a replaceable or exchangeable structural unit containing a motor-driven guide means according to the invention.

FIG. 4 shows a third embodiment example of a hand tool 61 with a piston-like exchangeable added structural unit corresponding the guide means 63. A handle 84 is suitable for receiving batteries, not shown, and a drive 71 with which the guide means 63 can be operated without electrical connection cables. An adaptor sleeve 85, which is securely connected with the handle 85, is dimensioned in such a way that it can be coupled with hot-sealing pistols, angle grinders, circular or compass saws, and cutting tools, particularly shadow joint cutting tools.

A switchable free-wheeling clutch not shown, is provided between the first drive 11,41 and the base-bearing members 15, 45, 75. An added switch, pressure switch 29 in FIG. 1, switches on the drive 11,41 and also the second drive 49, respectively, via the base-bearing member 15,45,75 when power is applied. The drives are switched on when the base-bearing member is brought into contact with the base or working surface. When the base-bearing member is lifted from the work surface, the added switch switches off the drive 11,54 and the second drive 49.

Figure 5:
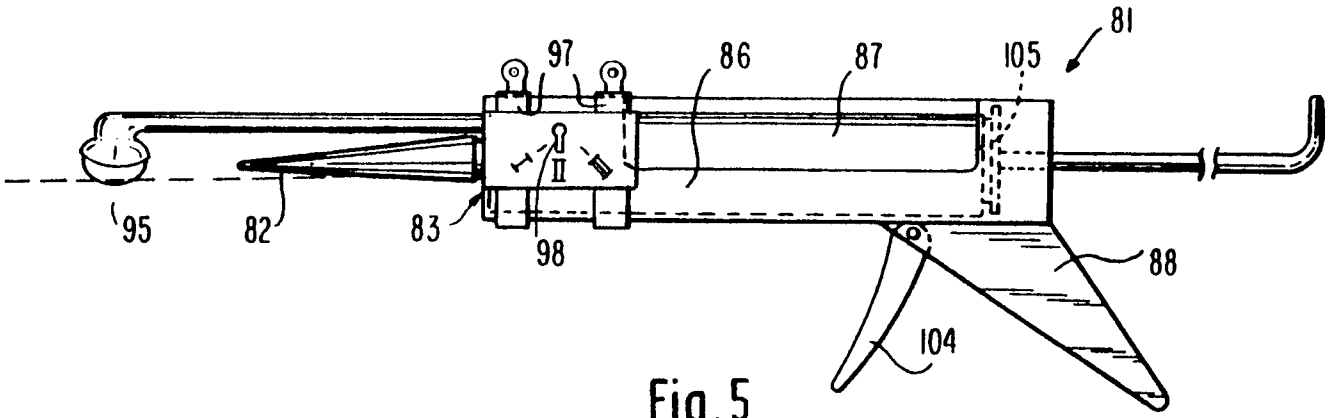
FIG. 5 is a schematic side view of a forth embodiment of a hand tool with hand-actuated pressing piston and motor-driven guide means.

Another embodiment of the invention is shown in FIG. 5. In this embodiment the base-bearing member 95 is a rotatably driven ball. Otherwise this embodiment is almost identical to the embodiment shown in FIG. 1. A containing means 87 for the free-flowing pasty material is held in a holder or cylinder 86. A means for forcing the free-flowing pasty material out of the nozzle 82 includes a piston device 105 and an actuating lever 104 as well as unshown gears which connect the former with the latter, so that the piston device 105 can be moved toward the nozzle 82 manually. A handle 88 is also provided. The guide means 83 can also be part of an exchangeable structural unit and is attached via straps 97 to the holder 86.

Description of operation: When using the hand tool 1 shown in FIG. 1 the base-bearing member 15, which is constructed as a wheel, is first placed on the surface to be treated, so that the nozzle 2 is positioned as close as necessary to the application point for the material. The actuating lever 4 is tightened by hand so that the piston 5 exerts a delivery pressure on the container 7. The material then issues from the nozzle 2. The function selector switch 18 must be located at this moment in the switching position corresponding to the respective desired guide direction. As soon as the first drive 11 drives the base-bearing member 15, which is constructed as a wheel, the hand tool 1 is moved in the preselected direction. In so doing, the operator need only adjust lateral deviations of the nozzle 2 from the provided guide direction and the delivery quantity.

The work cycle is ended by completely relaxing the actuating lever 4 and lifting the nozzle 2 and the base-bearing member 15 from the surface to be treated. In so doing, the energy supply for the first drive 11 is to be interrupted by correspondingly switching the function selector switch 18 and accordingly stopping the guide means.

The operation of a hand tool 31 which is provided with a second drive 49, as is shown in FIG. 3, is effected as follows: After placing the base-bearing member 45 or the wheel, respectively, on the surface to be treated and positioning the nozzle 32 is a provided work position as well as setting the desired movement direction of the wheel with the function selector switch 48, the operating switch 53 is actuated. The circuit for the second drive 49 and for the drive 41 is then closed.

The feed movement of the guide means is initiated at the same time as the movement of the piston 35. The wheel rotates faster or slower depending on the position of the operating switch 53. Control electronics, not shown, are actuated via the operating switch 53.

The quantity of material applied on the surface to be treated can be varied by varying the actuating force on the operating switch 53.

If the control electronics, not shown, are coupled with the second drive 49, the delivery quantity can be varied by varying the actuating force on the operating switch 53 at constant speed of the guide means.

The operating switch 53 is to released at the and of the work process. The movement of the guide means ends. However, the second drive 49 executes a reversal of the rotation direction with a defined number of rotations opposite the original drive direction so as to be controlled by the control electronics. Material is accordingly prevented from exiting the nozzle 32 after the end of the work cycle as a result of elasticity in the force transmission system.

While the invention has been illustrated and described as embodied in an automatically guidable hand tool for applying free-flowing pasty materials to a base, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

I claim:

1. Hand tool for applying free-flowing pasty materials including adhesives and sealants to a base, said hand tool comprising a nozzle; means for containing a free-flowing pasty material communicating with the nozzle, means for forcing the free-flowing pasty material out of the means for containing through the nozzle, and guide means for supporting the hand tool on the base to which the free-flowing pasty material is to be applied and for guiding the hand tool during application of the free-flowing pasty material to the base, said guide means comprising a first housing part attachable to the means for containing the free-flowing pasty material; a rotatable base-bearing member (15,45,75,95) selected from the group consisting of wheels and balls, the base-bearing member being connected rotatably to the first housing part and spaced a distance from the nozzle; means for adjusting the distance of the base-bearing member (15,45,75,95) from the nozzle (2,32,62,82); a first drive (11,41,71) connected to the rotatable base-bearing member (15,45,75,95) to drive the rotatable base-bearing member rotatably to provide a controlled movement of the guide means over the base during application of the free flowing pasty material when the base-bearing member contacts the base; and means for selecting one of two opposite rotation directions of the base-bearing member (15,45,75,95) connected to the first drive (11,41,71), wherein the means for containing the free-flowing pasty material comprises a container with a displaceable base and the means for forcing the free-flowing pasty material out of the means for containing the free-flowing pasty material includes a cylinder for holding the means for containing the free-flowing pasty material, a piston acting on the displaceable base of the container, and a second drive including an electric motor for pressing the piston onto the displaceable base to force the free-flowing pasty material from the nozzle.

2. Hand Tool as defined in claim 1, wherein the first drive (41) in the guide means is connected to the second drive (49) so that the first drive (41) for the base-bearing member is controlled by the second drive (49).

3. Hand Tool as defined in claim 1, further comprising an exchangeable structural unit including the guide means attachable to and detectable from the means for containing.

4. Hand Tool as defined in claim 1, wherein the guide means includes a switch, said switch actuating the first drive (11,41,71) when said base-bearing member (15,45,75,95) contacts the base and turning off said first device (11,47,71) when said base-bearing member (15,45,75,95) is lifted from the base.

5. Hand Tool as defined in claim 1, wherein the means for adjusting the distance of the base-bearing member (15,45,75,95) from the nozzle (2,32,62,82) includes a second housing part rigidly attachable to the means for containing and structured so that the first housing part containing the first drive can be mounted in the second housing part in a telescoping manner so that the distance can be changed.

6. A hand tool for applying free-flowing pasty materials including adhesives and sealants to a base, said hand tool including a container with a displaceable base and a nozzle for the free-flowing pasty material, a cylinder for holding the container and a piston engagable with the displaceable base to move the displaceable base and to force the free-flowing pasty material from the container, and guide means for supporting the hand tool on the base to which the free-flowing pasty material is to be applied and for guiding the hand tool during application of the free-flowing pasty material, the guide means being at least a part of a single exchangeable structural unit attachable to the cylinder and comprising a first housing part connectable to the cylinder; a rotatable base-bearing member selected from the group consisting of wheels and balls, the base-bearing member being connected rotatably to the first housing part and spaced a distance from the nozzle; means for adjusting the distance of the base-bearing member from the nozzle; and a first drive including a first electric motor connected to the rotatable base-bearing member to drive the rotatable base-bearing member rotatably and to thus provide a controlled movement of the hand tool over the base during application of the free-flowing pasty material when the base-bearing member contacts the base.

7. A hand tool as defined in claim 6, wherein the guide means also includes means for selecting a rotation direction of the base-bearing member connected o the first drive.

8. A hand tool as defined in claim 6, wherein the means for adjusting the distance of the base-bearing member from the nozzle includes a second housing part rigidly attachable to the cylinder and structured so that the first housing part containing the first drive can be mounted in the second housing part in a telescoping manner.

* * * * *